US010179893B2

(12) United States Patent
Ekanayake et al.

(10) Patent No.: US 10,179,893 B2
(45) Date of Patent: Jan. 15, 2019

(54) SOLVENT FOR CLEANING TURBINE COMPONENTS

(71) Applicant: GENERAL ELECTRIC COMPANY, Schenectady, NY (US)

(72) Inventors: Sanji Ekanayake, Mableton, GA (US); Surinder Singh Pabla, Greer, SC (US); Murali Krishna Kalaga, Karnataka (IN); Alston Ilford Scipio, Mableton, GA (US); Ishmael Dean El, Atlanta, GA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 73 days.

(21) Appl. No.: 15/397,396

(22) Filed: Jan. 3, 2017

(65) Prior Publication Data

US 2017/0114307 A1 Apr. 27, 2017

Related U.S. Application Data

(62) Division of application No. 14/152,335, filed on Jan. 10, 2014, now Pat. No. 9,567,554.

(51) Int. Cl.

| | |
|---|---|
| ***C11D 7/50*** | (2006.01) |
| ***C11D 11/00*** | (2006.01) |
| ***F01D 25/00*** | (2006.01) |
| ***C11D 3/37*** | (2006.01) |
| ***B08B 3/04*** | (2006.01) |
| ***B08B 3/10*** | (2006.01) |
| ***C11D 7/34*** | (2006.01) |
| ***C11D 3/04*** | (2006.01) |
| ***C11D 3/18*** | (2006.01) |

(Continued)

(52) U.S. Cl.

CPC ..... *C11D 11/0041* (2013.01); *B08B 3/04* (2013.01); *B08B 3/102* (2013.01); *C11D 3/044* (2013.01); *C11D 3/18* (2013.01); *C11D 3/3427* (2013.01); *C11D 3/3749* (2013.01); *C11D 7/34* (2013.01); *C11D 7/5027* (2013.01); *F01D 25/002* (2013.01); *B08B 3/02* (2013.01); *B08B 17/025* (2013.01)

(58) Field of Classification Search

CPC ..... C10M 2219/089; C11D 11/0041
USPC ..... 510/185
See application file for complete search history.

(56) References Cited

U.S. PATENT DOCUMENTS 4,016,093 A * 4/1977 Koft, Jr. ..... C10L 1/2412 252/75
4,529,452 A 7/1985 Walker
(Continued)

FOREIGN PATENT DOCUMENTS

RU 2373306 C2 11/2009

*Primary Examiner* — Gregory E Webb
(74) *Attorney, Agent, or Firm* — McNees Wallace & Nurick LLC

(57) ABSTRACT

A cleaning method and a cleaning fluid are provided. The cleaning method includes accessing a plurality of turbine components attached to a turbine assembly, the turbine assembly being a portion of a turbomachine, positioning at least one cleaning vessel over at least one of the turbine components, forming a liquid seal with a sealing bladder, providing a cleaning fluid to the cleaning vessel, and draining the cleaning fluid from the cleaning vessel. The cleaning fluid includes a carrier fluid and a solvent additive for removing fouling material from the turbine component. An alternative cleaning method is also provided.

16 Claims, 6 Drawing Sheets

(51) Int. Cl.

| | |
|---|---|
| ***C11D 3/34*** | (2006.01) |
| *B08B 3/02* | (2006.01) |
| *B08B 17/02* | (2006.01) |

(56) References Cited

U.S. PATENT DOCUMENTS

| | | | | |
|---|---|---|---|---|
| 4,851,149 | A | 7/1989 | Carandang | |
| 5,183,555 | A * | 2/1993 | Forester | C10G 9/16 208/48 AA |
| 5,217,586 | A | 6/1993 | Datta et al. | |
| 6,073,637 | A | 6/2000 | Hayward et al. | |
| 6,153,648 | A | 11/2000 | Makino et al. | |
| 6,482,334 | B2 | 11/2002 | Kovalev et al. | |
| 6,712,080 | B1 | 3/2004 | Handschuh et al. | |
| 9,163,322 | B2 | 10/2015 | DiMascio et al. | |
| 2004/0209783 | A1 * | 10/2004 | Wells | C10M 169/045 508/192 |
| 2007/0027057 | A1 * | 2/2007 | Le Coent | C10M 159/22 510/505 |
| 2010/0249000 | A1 * | 9/2010 | Kamano | C10M 125/26 508/185 |
| 2015/0080282 | A1 * | 3/2015 | Krishna | C11D 3/0073 510/185 |

* cited by examiner

SOLVENT FOR CLEANING TURBINE COMPONENTS

CROSS REFERENCE TO RELATED APPLICATIONS

This application relates to and claims the benefit of U.S. patent application Ser. No. 14/152,335, filed Jan. 10, 2014, entitled "Apparatus, Method, and Solvent for Cleaning Turbine Components," the disclosures of which are incorporated by reference in their entirety.

FIELD OF THE INVENTION

The present invention is directed to an apparatus, a method, and a solvent for cleaning turbine components. More specifically, the present invention is directed to an apparatus, a method, and a solvent for removing fouling material from turbine components.

BACKGROUND OF THE INVENTION

Gas turbines (GT) are often subjected to harsh operating conditions and prolonged operation times, leading to fouling of turbine components. For GT compressor components, fouling may adversely affect the aerodynamic performance of the turbine components by increasing the coefficient of drag (CD) and resulting in reduced performance. Usually during major inspections, which are conducted at predetermined intervals, turbine components such as rotor blades and stator vanes are manually scrubbed and/or cleaned to partially restore the surface finish of the blades and vanes. The scrubbing and/or cleaning of the rotor blades and vanes improves the surface finish, partially restoring GT output and efficiency. However, current methods of cleaning do not fully restore the surface finish to that of a new turbine component.

Manual scrubbing and/or cleaning of the rotor blades is a time-consuming process which results in a less than optimal surface finish of the blade. An alternative to manual scrubbing and/or cleaning of the rotor blades is submerging the turbine components in a cleaning fluid.

Submerging of the rotor blades in a cleaning fluid provides an improved surface finish of the blade, as compared to manual scrubbing. However, current methods and/or cleaning fluids require disassembly and/or transportation of the GT. Disassembly and transportation increase the GT downtime, resulting in lost productivity. Downtime for transportation of the GT can be up to two months.

A cleaning method that does not suffer from one or more of the above drawbacks is desirable in the art.

BRIEF DESCRIPTION OF THE INVENTION

In one exemplary embodiment, a method for cleaning a gas turbine includes accessing a plurality of turbine components attached to a turbine assembly, the turbine assembly being a portion of a turbomachine, positioning at least one cleaning vessel over at least one of the turbine components, forming a liquid seal with a sealing bladder, providing a cleaning fluid to the cleaning vessel, and draining the cleaning fluid from the cleaning vessel. The cleaning fluid comprises a carrier fluid and a solvent additive for removing fouling material from the turbine component.

In another exemplary embodiment, a method for cleaning a gas turbine includes accessing a plurality of turbine components attached to a turbine assembly, the turbine assembly being a portion of a turbomachine, providing a cleaning fluid in a cleaning vessel, rotating the plurality of turbine components to at least partially immerse the turbine components in the cleaning fluid in the cleaning vessel, and separating the plurality of turbine components from the cleaning fluid in the cleaning vessel. The cleaning fluid comprises a carrier fluid and a solvent additive for removing a fouling material from the turbine components.

In another exemplary embodiment, a cleaning fluid for cleaning a gas turbine includes a solvent additive, and a carrier fluid. The solvent additive is capable of removing fouling material from a turbine component immersed in the cleaning fluid.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are a cleaning fluid and methods for cleaning a gas turbine. Embodiments of the present disclosure, in comparison to methods and cleaning fluids not using one or more of the features disclosed herein, increase cleaning efficiency, decrease turbine downtime, decrease turbine transportation, decrease labor for polishing, decrease cost of cleaning fluid, decrease cleaning time, increase cleaning effectiveness, or a combination thereof.

Figure 1:
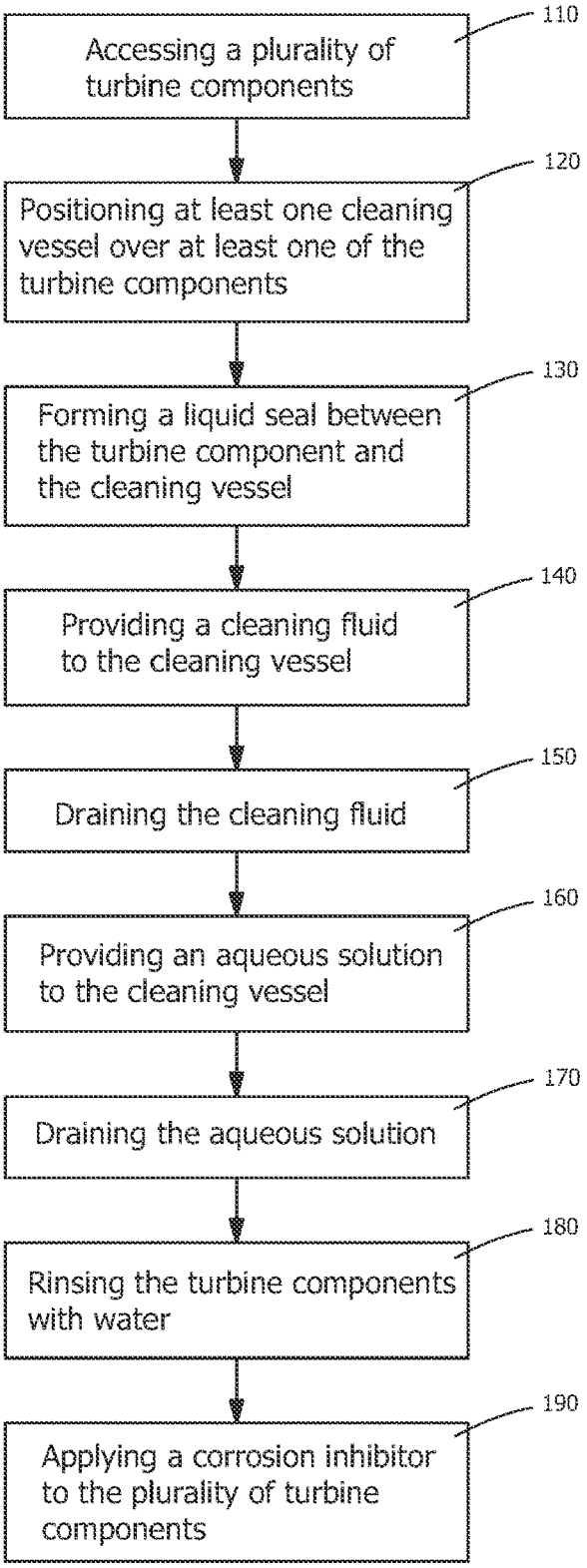
FIG. 1 is a flow chart of a cleaning method, according to an embodiment of the disclosure.
Figure 2:
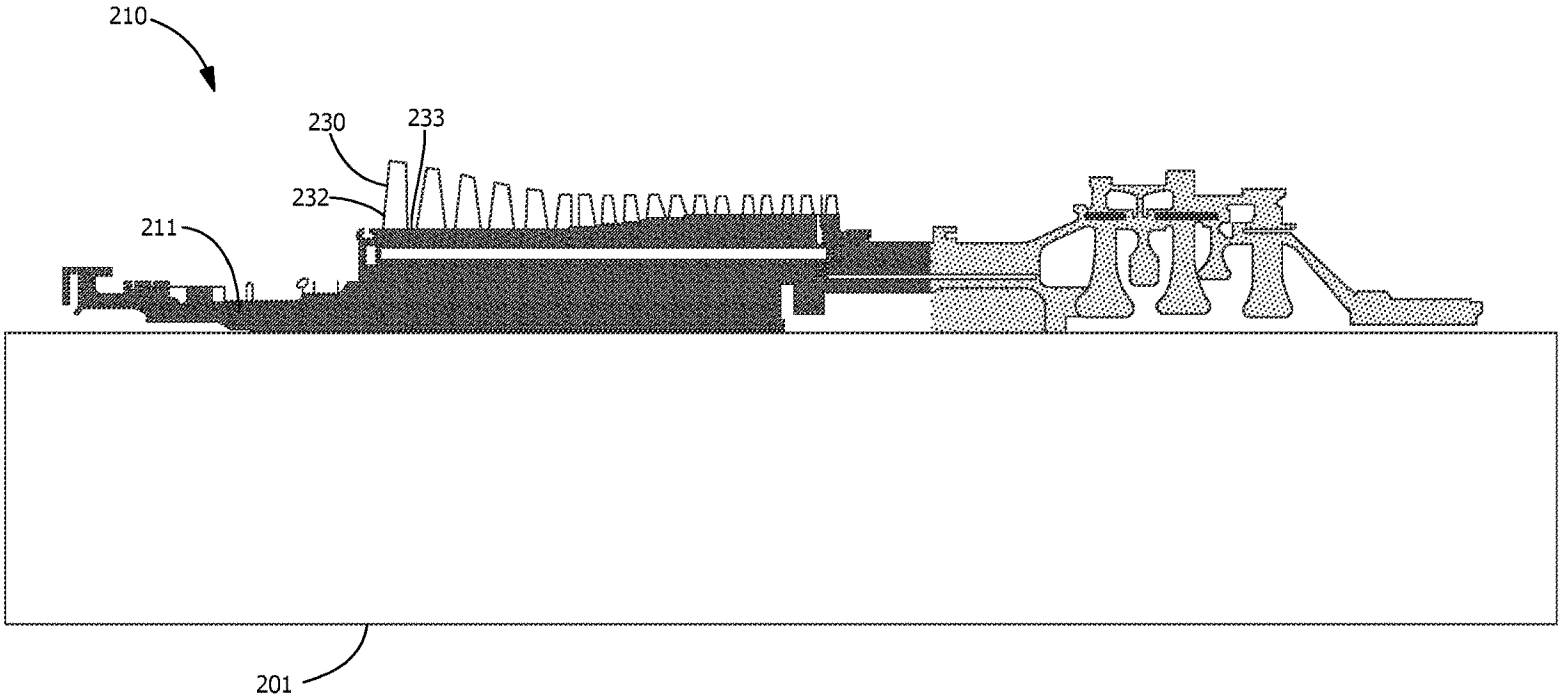
Prior Art FIG. 2
FIG. 2 shows a turbomachine having an upper casing removed.

Referring to FIGS. 1-2, a method for cleaning a gas turbine is provided. In one embodiment, the method is performed in-situ. For purposes of this application, in-situ means at the operational site or venue of the turbine, such as during a planned inspection. In another embodiment, the method for cleaning the gas turbine includes accessing (step 110) a plurality of turbine components 230 attached to a turbine assembly 210, the turbine assembly 210 being a portion of a turbomachine 201. For example, accessing (step 110) the plurality of turbine components 230 may include removing a rotor upper casing to expose a portion of the turbine assembly 210. The plurality of turbine components 230 includes any suitable turbine component, such as, but not limited to, a compressor blade 232, a rotor blade, a stator vane, or a combination thereof. In one embodiment, the plurality of turbine components 230 include platform sections affixed to compressor discs 233 which are attached to a turbine shaft or sub-shaft 211 of the turbine assembly 210. Exemplary turbine series include, but are not limited to, turbine series 6FA, 7FA, and 9FA produced by General Electric Company, and the turbine assemblies 210 removed from such series.

Figure 3:
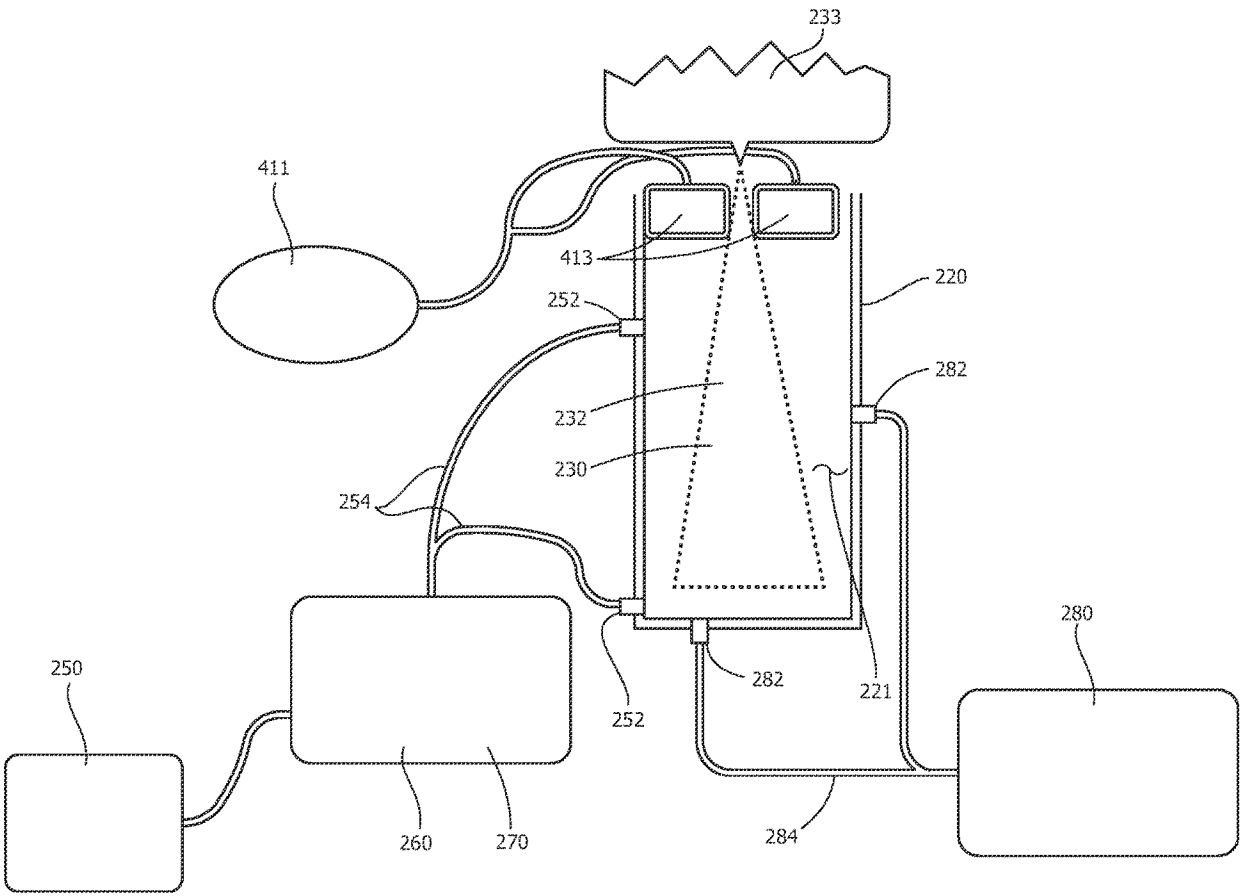
FIG. 3 is a schematic view of a cleaning vessel positioned over a turbine component, according to an embodiment of the disclosure.

As shown in FIGS. 1-3, at least one cleaning vessel 220 including a sealing bladder 413 is then positioned (step 120) over at least one of the turbine components 230. The sealing bladder 413 forms (step 130) a liquid seal between the turbine component 230 and the cleaning vessel 220. Positioning (step 120) more than one cleaning vessel 220 over more than one of the turbine components 230 permits simultaneous cleaning of the turbine components 230. In one embodiment, prior to positioning the cleaning vessel 220 (step 120), the turbine components 230 are optionally sprayed with a fluid to remove loose debris. Next, a cleaning fluid 221 is provided to the cleaning vessel 220 (step 140) to immerse the turbine component 230 and remove a fouling material from the turbine component 230. The turbine components 230 are immersed in the cleaning fluid 221 for a predetermined time, and/or until the turbine components 230 include a predetermined finish, and then the cleaning fluid 221 is drained (step 150) from the cleaning vessel 220. In another embodiment, the cleaning fluid 221 within the cleaning vessel 220 is agitated to increase a rate of removal of the fouling material from the turbine component 230.

The cleaning fluid 221 includes a carrier fluid and a solvent additive. The carrier fluid includes any suitable solvent for carrying the solvent additive, such as, but not limited to, a distillate. Suitable distillates include, but are not limited to, petrochemical distillates such as naphtha, heavy aromatic naphtha, kerosene, diesel, or a combination thereof. The cleaning fluid 221 includes any suitable amount of the solvent additive, such as, but not limited to, up to about 99%, between about 1% and about 50%, between about 1% and about 30%, between about 10% and about 30%, between about 1% and about 20%, up to about 15%, between about 10% and about 20%, between about 5% and about 10%, about 10%, or any combination, sub-combination, range, or sub-range thereof.

The solvent additive includes any suitable solvent additive capable of removing the fouling material from the turbine component 230. In one embodiment, the solvent additive includes a calcium long chain alkyl phenate sulfide. In another embodiment, the calcium long chain alkyl phenate sulfide includes, by weight percent, between about 8.7% and about 9.7% calcium, between about 8.9% and about 9.5% calcium, between about 9.1% and about 9.3% calcium, about 9.2% calcium, or any combination, sub-combination, range, or sub-range thereof. In a further embodiment, the calcium long chain alkyl phenate sulfide includes, by weight percent, between about 2.75% and about 3.75% sulfur, between about 2.95% and about 3.55% sulfur, between about 3.15% and about 3.35% sulfur, about 3.25% sulfur, or any combination, sub-combination, range, or sub-range thereof. For example, one suitable composition of the calcium long chain alkyl phenate sulfide includes, by weight percent, between about 8.7% and about 9.7% calcium, and between about 2.75% and about 3.75% sulfur, with a total base number of between about 225 and about 275 mg KOH/g.

In one embodiment, the solvent additive includes a mix of calcium alkyl phenol sulfide and polyolefin phosphorosulfide. In another embodiment, the mix of calcium alkyl phenol sulfide and polyolefin phosphorosulfide includes, by weight percent, between about 1.1% and about 2.1% calcium, between about 1.3% and about 1.9% calcium, between about 1.55% and about 1.65% calcium, or any combination, sub-combination, range, or sub-range thereof. In a further embodiment, the mix of calcium alkyl phenol sulfide and polyolefin phosphorosulfide includes, by weight percent, between about 0.5% and about 1.5% phosphorous, between about 0.7% and about 1.3% phosphorous, between about 0.9% and about 1.03% phosphorous, or any combination, sub-combination, range, or sub-range thereof. In a further embodiment, the mix of calcium alkyl phenol sulfide and polyolefin phosphorosulfide includes, by weight percent, between about 2.0% and about 3.5% sulfur, between about 2.3% and about 3.3% sulfur, between about 2.4% and about 3.2% sulfur, or any combination, sub-combination, range, or sub-range thereof. For example, one suitable composition of the mix of calcium alkyl phenol sulfide and polyolefin phosphorosulfide includes, but is not limited to, by weight percent, between about 1.1% and about 2.1% calcium, between about 0.5% and about 1.5% phosphorus, and between about 2.3% and about 3.3% sulfur, with a total base number of between about 25 and about 75 mg KOH/g.

In another embodiment, after draining the cleaning fluid 221 (step 150) an aqueous solution is optionally provided (step 160) to the cleaning vessel 220 to remove the cleaning fluid 221 from the turbine component 230. The turbine component 230 having the predetermined finish is immersed in the aqueous solution for a second predetermined time to remove the cleaning fluid 221, then the aqueous solution is drained (step 170) from the cleaning vessel 220.

In another embodiment, the turbine components 230 having the predetermined finish are optionally rinsed with water to remove the aqueous solution. The rinsing of the turbine components 230 with water includes any suitable method for removing the aqueous solution. For example, in one embodiment, prior to removing the cleaning vessel 220, the water is provided to the cleaning vessel 220 then subsequently drained from the cleaning vessel 220 to remove the aqueous solution. In an alternate embodiment, after draining the aqueous solution (step 170), the cleaning vessel 220 is removed from the turbine component 230 and the turbine components 230 are subsequently sprayed with the water (e.g., power washed), to rinse the turbine components 230 and remove the aqueous solution. Once the fouling material has been removed from the turbine components 230, the turbine components 230 have been rinsed, and the cleaning vessels 220 have been removed from the turbine components 230, a dry corrosion inhibitor is applied over the turbine components 230. The dry corrosion inhibitor is applied as any suitable solution, such as, but not limited to, a water based solution which is dried over the turbine components 230. The application of the dry corrosion inhibitor includes, but is not limited to, spraying, painting, dipping, rubbing, or a combination thereof. The dry corrosion inhibitor reduces or eliminates formation of corrosion on portions of the turbine components 230 exposed during removal of the fouling material by the cleaning method.

In an alternate embodiment, once the fouling material has been removed from the turbine components 230 and the cleaning fluid 221 is drained (step 150) from the cleaning vessel 220, the cleaning vessel 220 is removed from turbine component 230 without providing an aqueous solution (step 160) or rinsing the turbine components 230 with water. The cleaning fluid 221 remains on the turbine components 230 and acts to reduce or eliminate corrosion of the turbine component 230, permitting completion of the method without removal of the cleaning fluid 221 or application of the dry corrosion inhibitor.

The removing of the fouling material from the turbine component 230 decreases a build-up of fouling material, which may accumulate on the turbine components 230 during operation of the turbomachine 201. The fouling material includes, but is not limited to, a petrochemical film, oxidation, corrosion, foreign objects, such as sand or dust, which may be ingested by the turbomachine 201, loose film, other materials that form a film over the turbine component 230, or a combination thereof. Decreasing or eliminating the build-up of fouling material on the turbine component 230 increases an aerodynamic efficiency of the turbine component 230, thus increasing the efficiency of the turbomachine 201.

Referring to FIG. 3, in one embodiment, the sealing bladder 413 includes any suitable device for filling a space between the turbine component 230 and the cleaning vessel and forming the liquid seal. Suitable seals include, but are not limited to, pneumatic seals, circumferential seals, or a combination thereof. In another embodiment, the sealing bladder 413 is configured to follow a contour of the turbine component 230. In a further embodiment, the sealing bladder 413 is coupled to an air bladder pump 411 that inflates the sealing bladder 413 to create the liquid seal.

The liquid seal formed by the sealing bladder 413 retains a liquid (e.g., the cleaning fluid 221, the aqueous solution, water) within the cleaning vessel 220 to permit immersing of the turbine component 230 in any orientation. For example, in one embodiment, the plurality of turbine components 230 that are accessed (step 110) by removing the rotor upper casing are extending away from the turbine assembly 210 in a direction generally opposite that of gravity. The cleaning vessel 220 positioned (step 120) over the turbine component 230 includes an opening facing opposite the direction of the turbine component 230. As liquid is provided to the cleaning vessel 220, the sealing bladder 413 retains the liquid within the cleaning vessel 220 and permits a filling of the cleaning vessel 220 with the liquid.

Figure 4:
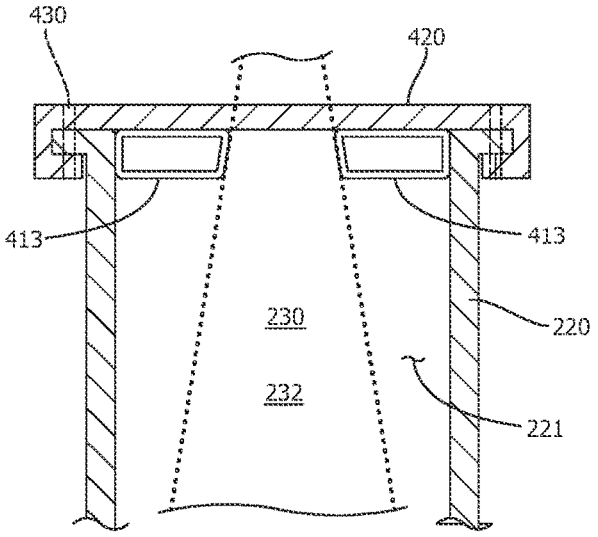
FIG. 4 is a schematic view of a cleaning vessel and a seal support, according to an embodiment of the disclosure.
Figure 5:
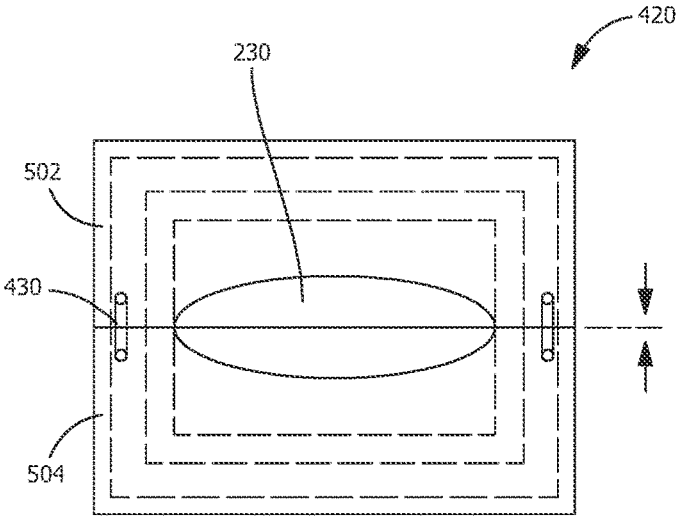
FIG. 5 is a top view of a seal support, according to an embodiment of the disclosure.

Referring to FIGS. 4-5, in one embodiment, a seal support 420 is optionally positioned over the opening in the cleaning vessel 220 to increase retention of the liquid within the cleaning vessel 220. The seal support 420 includes a first side 502 coupled to a second side 504 with a securing member 430. The securing member 430 is any suitable member for coupling the first side 502 to the second side 504, such as, but not limited to, a securing pin. The first side 502 and the second side 504 form a central opening to permit passage there through of the turbine component 230. Upon completion of cleaning the turbine component 230, the seal support 420 is removed, the sealing bladder 413 is vented, and the cleaning vessel 220 is removed from the turbine component 230.

In one embodiment, the liquid is provided to the cleaning vessel 220 from at least one liquid supply tank 250. The at least one liquid supply tank 250 is coupled to at least one liquid supply fitting 252 on the cleaning vessel 220 through at least one liquid supply line 254. In another embodiment, one or more liquid pumps 260 force the liquid from the at least one liquid supply tank 250, through the at least one liquid supply line 254, to fill the cleaning vessel 220. The one or more liquid pumps 260 may be integral with a valve manifold 270 for controlling liquid flow from the at least one liquid supply tank 250. A single type of liquid is provided in each of the at least one liquid supply tanks 250. For example, in one embodiment, the cleaning fluid 221 is provided in at least one cleaning fluid supply tank, the aqueous solution is provided in at least one aqueous solution supply tank, and the water is provided in at least one water supply tank.

In one embodiment, the cleaning vessel 220 includes at least one liquid return fitting 282 coupled to at least one liquid return tank 280 through at least one liquid return line 284, the liquid return tank 280 being separate from the liquid supply tank 250. In an alternate embodiment, a single tank forms the liquid supply tank 250 and the liquid return tank 280 to create a closed loop including the cleaning vessel 220. The at least one liquid supply fitting 252 and the at least one liquid return fitting 282 permit filling and draining of the cleaning vessel 220 without venting the sealing bladder 413 and breaking the liquid seal.

For example, in one embodiment, the cleaning fluid supply tank, the aqueous solution supply tank, and the water supply tank are coupled to the at least one liquid supply fitting 252 through the liquid supply lines 254 attached to the liquid pump 260 integral with the valve manifold 270. After pressurizing the sealing bladder 413 to form the liquid seal, the cleaning vessel 220 is filled with the cleaning fluid 221 from the cleaning fluid supply tank. The cleaning fluid 221 removes the fouling material from the turbine component 230 within the cleaning vessel 220, and is then drained from the cleaning vessel 220 to the liquid return tank 280 through the liquid return fitting 282. The aqueous solution and the water are subsequently provided to, and drained from the cleaning vessel 220 in the same manner. In another embodiment, the liquid is provided to the cleaning vessel 220 concurrently with the draining of the liquid from the cleaning vessel 220. The liquid is provided at an increased rate as compared to the draining, to permit filling of the cleaning vessel 220. Together, the providing of the liquid and the draining of the liquid agitate the liquid within the cleaning vessel 220 to provide increased cleaning of the turbine components 230.

Figure 6:
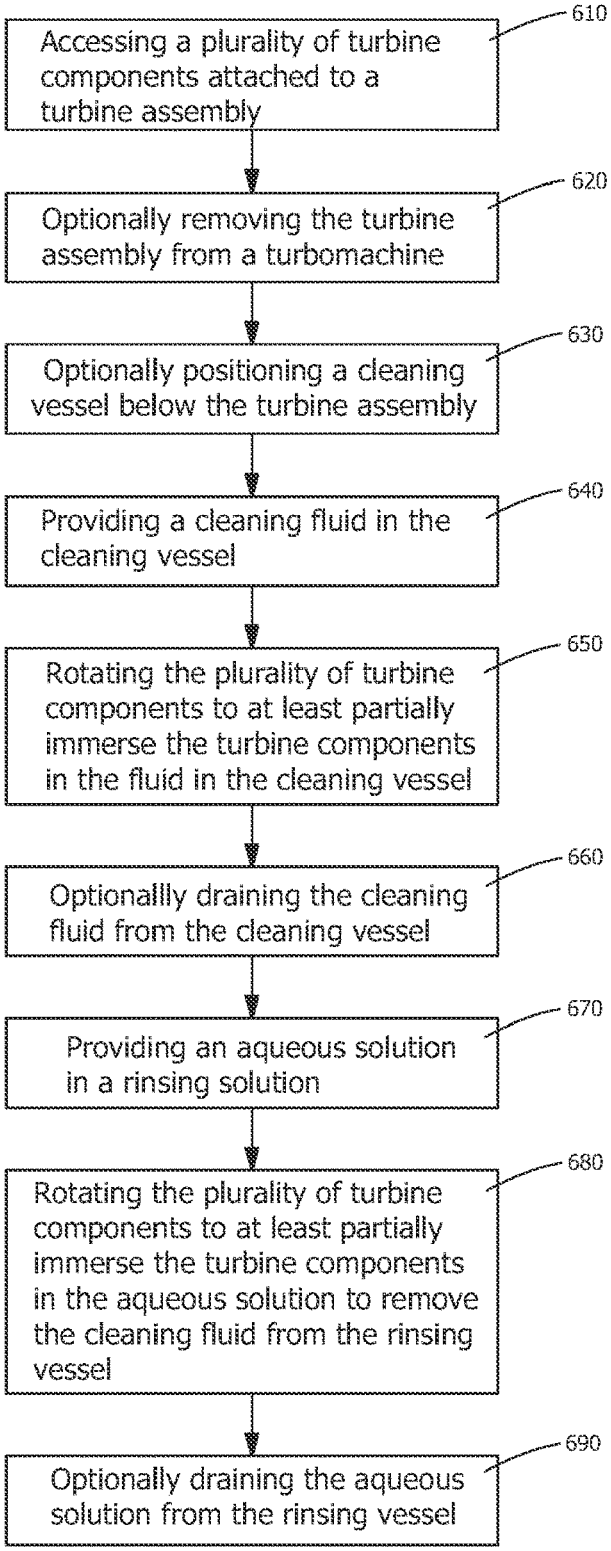
FIG. 6 is a flow chart of a cleaning method, according to an embodiment of the disclosure.
Figure 7:
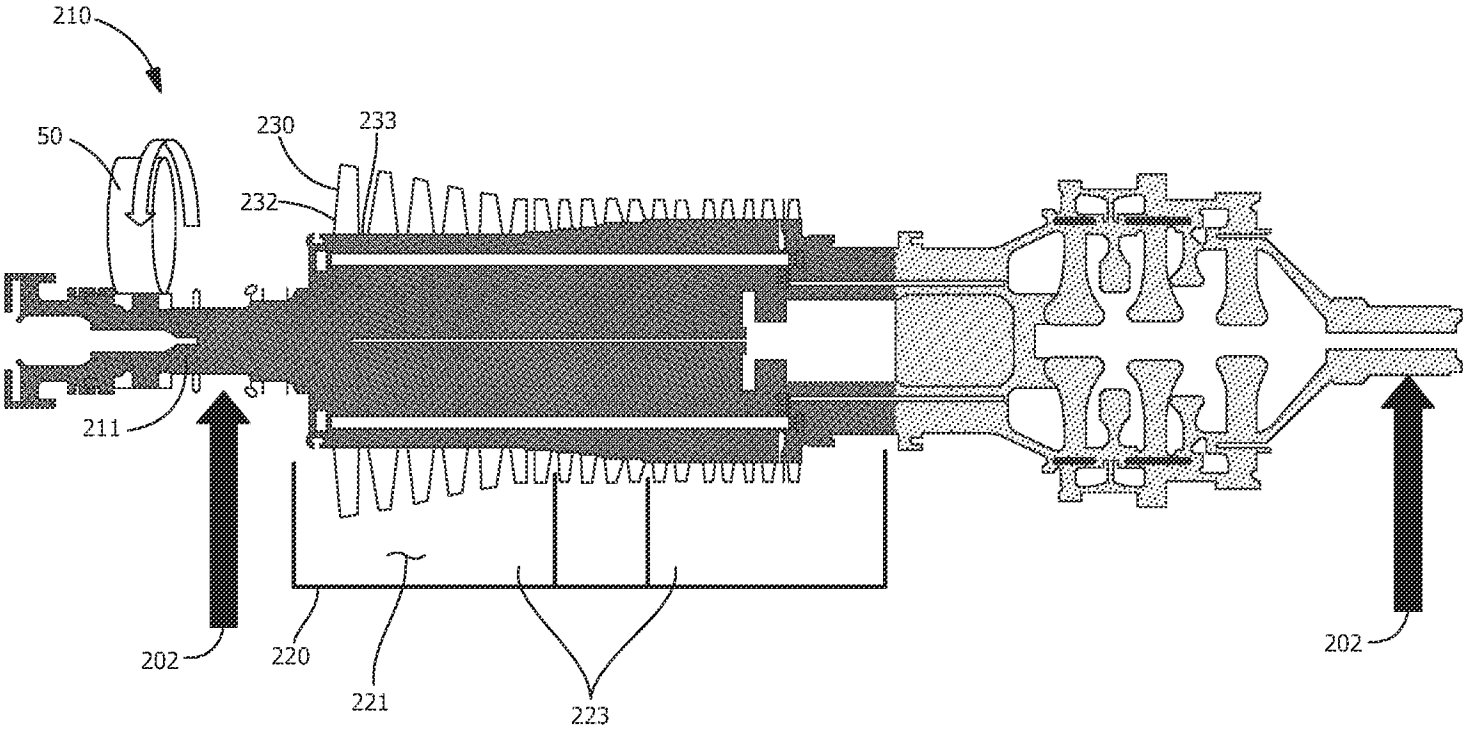
FIG. 7 is a sectional view of a cleaning vessel positioned below a turbine assembly, according to an embodiment of the disclosure.

Referring to FIGS. 6-7, in an alternate embodiment, the method for cleaning the gas turbine includes accessing (step 610) the plurality of turbine components 230 attached to the turbine assembly 210, and optionally removing the turbine assembly 210 from the turbomachine 201 (step 620). After removing the turbine assembly 210 from the turbomachine 201 (step 620), the turbine assembly 210 is placed on supports 202 configured to suspend and/or rotate the turbine assembly 210. The cleaning vessel 220 is then optionally positioned (step 630) below the turbine assembly 210, and the cleaning fluid 221 is provided in the cleaning vessel 220 (step 640). In an alternate embodiment, a liner is positioned within the turbomachine 201 and the cleaning fluid 221 is provided to the turbomachine 201, permitting cleaning of the gas turbine without removing the turbine assembly 210. In another embodiment, the cleaning vessel 220 may be positioned within the turbomachine 201 to form the liner.

The turbine assembly 210 is then rotated to rotate the plurality of turbine components 230 and at least partially immerse the turbine components 230 in the cleaning fluid 221 in the cleaning vessel 220 (step 650). The immersion of the plurality of turbine components 230 in the cleaning fluid 221 removes the fouling material from the turbine components 230 to form the predetermined finish. After forming the predetermined finish, the cleaning fluid 221 is optionally drained (step 660) from the cleaning vessel 220. In another embodiment, the aqueous solution is then optionally provided in a rinsing vessel (step 670), and the plurality of turbine components 230 having the predetermined finish are rotated to at least partially immerse the turbine components 230 in the aqueous solution and remove the cleaning fluid 221 (step 680). After immersing the turbine component 230 in the aqueous solution, the aqueous solution is optionally drained from the rinsing vessel.

In one embodiment, the cleaning vessel 220 forms a rinsing vessel to permit cleaning and rinsing of the turbine components 230 in the same vessel. In an alternate embodiment, the cleaning vessel 220 is separate from the rinsing vessel to permit cleaning and rinsing of the turbine components 230 without draining of the cleaning fluid 221 or the aqueous solution. For example, after forming the predetermined finish, the cleaning vessel 220 with the cleaning fluid 221 may be separated from the turbine assembly 210, and the rinsing vessel with the aqueous solution may be positioned relative to the turbine assembly 210. The cleaning and rinsing of the turbine components 230 without draining of the cleaning fluid 221 or the aqueous solution permits re-use of the cleaning fluid 221 and/or the aqueous solution.

In one embodiment, subsequent to removing the cleaning fluid 221 with the aqueous solution, the plurality of turbine components 230 are rinsed with water to remove the aqueous solution, and then the dry corrosion inhibitor is applied over the turbine components 230 having the predetermined finish. The plurality of turbine components 230 may be rinsed by any suitable method. For example, in one embodiment, upon completion of cleaning the turbine components 230, the cleaning vessel 220 is removed from below the turbine assembly 210 and the turbine components 230 are power washed. In an alternate embodiment, water is provided to the cleaning vessel 220 and the turbine components 230 are rotated through the water to remove the aqueous solution from the turbine components.

In an alternate embodiment, once the fouling material has been removed from the turbine components 230, the cleaning fluid 221 is optionally drained (step 660) and/or the turbine components 230 are separated from the cleaning vessel 220 without subsequently immersing the turbine components 230 in the aqueous solution or rinsing the turbine components 230 with water. The cleaning fluid 221 remains on the turbine components 230 and acts to reduce or eliminate corrosion of the turbine component 230, permitting completion of the method without removal of the cleaning fluid 221 or application of the dry corrosion inhibitor.

Referring to FIG. 7, in one embodiment, the cleaning vessel 220 positioned below the turbine assembly 210 or within the turbomachine 201 includes one or more compartments 223 corresponding to one or more sections of turbine components 230 on the turbine assembly 210. In another embodiment, each compartment 223 includes the liquid maintained at a predetermined volume level. The predetermined volume level within each compartment 223 corresponds to a length of the turbine components 230 in the corresponding section of the turbine assembly 210. For example, in one embodiment, at least two of the sections extend away from a centerline of the turbine assembly 210 at a different length, the corresponding compartments 223 including differing predetermined volume levels based upon the length of the turbine components 230. In another embodiment, the predetermined volume level in each of the compartments 223 is the same, corresponding to the plurality of turbine components 230 extending away from the centerline of the turbine assembly 210 with the same length.

The rotation of the turbine assembly 210 to immerse the turbine components 230 in the cleaning fluid 221, the aqueous solution, and/or water, may be either continuous or intermittent, and is driven by a rotor drive 50. During either continuous or intermittent rotation, the rotation of the turbine assembly 210 includes a predetermined maximum speed. The predetermined maximum speed is a functional limitation, preventing the liquid from splashing out of the cleaning vessel 220. The predetermined maximum speed includes, but is not limited to, between about 1 and about 4 rotations per minute (RPM), between about 2 and about 4 RPM, between about 1 and about 3 RPM, between about 0.5 and about 1.5 RPM, between about 1 and about 2 RPM, between about 2 and about 3 RPM, between about 3 and about 4 RPM, or any suitable combination, sub-combination, range, or sub-range thereof. At or below the predetermined maximum speed, without splashing, the rotation of the turbine assembly 210 may still remove a portion of the liquid from the cleaning vessel 220. Additional liquid is added in some embodiments due to loss of the fluid from the cleaning vessel 220.

In one embodiment, a composition of the plurality of turbine components 230 differs along a length of the turbine assembly 210. The composition of the cleaning fluid 221 may vary between compartments 223 based upon the composition of the plurality of turbine components 230. In another embodiment, the plurality of turbine components 230 includes the compressor blades 232, which do not have a thermal barrier coating, such as is found on the turbine blades. Suitable compositions for the compressor blades 232 include, but are not limited to, high content steels, such as a precipitation-hardened steel or titanium.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cleaning fluid, comprising:
a distillate; and
a solvent additive including an alkyl phenolic sulfide, wherein the alkyl phenolic sulfide includes a mixture of calcium alkyl phenol sulfide and a polyolefin phosphorosulfide.

2. The cleaning fluid of claim 1, including between 1% and 50% by weight of the solvent additive.

3. The cleaning fluid of claim 2, including about 10% by weight of the solvent additive.

4. The cleaning fluid of claim 1, wherein the distillate includes a petrochemical distillate.

5. The cleaning fluid of claim 4, wherein the petrochemical distillate is selected from the group consisting of naphtha, heavy aromatic naphtha, kerosene, and diesel.

6. The cleaning fluid of claim 4, wherein the petrochemical distillate includes heavy aromatic naphtha.

7. The cleaning fluid of claim 1, wherein the distillate consists of heavy aromatic naphtha.

8. The cleaning fluid of claim 1, wherein the alkyl phenolic sulfide includes a long chain alkyl phenate sulfide.

9. The cleaning fluid of claim 8, wherein the long chain alkyl phenate sulfide includes a calcium long chain alkyl phenate sulfide.

10. The cleaning fluid of claim 9, wherein the calcium long chain alkyl phenate sulfide further includes between about 8.7% by weight and about 9.7% by weight calcium, and between about 2.75% by weight and about 3.75% by weight sulfur.

11. The cleaning fluid of claim 10, further including a total base number of between about 225 to about 275 mg KOH/g.

12. The cleaning fluid of claim 10, wherein the calcium long chain alkyl phenate sulfide further includes about 9.2% by weight calcium and about 3.25% by weight sulfur.

13. The cleaning fluid of claim 1, wherein the mixture of the calcium alkyl phenol sulfide and the polyolefin phosphorosulfide further includes between about 1.1% by weight and about 2.1% by weight calcium, between about 0.5% by weight and about 1.5% by weight phosphorus, and between about 2.3% by weight and about 3.3% by weight sulfur.

14. The cleaning fluid of claim 13, wherein the mixture of the calcium alkyl phenol sulfide and the polyolefin phosphorosulfide further includes a total base number of between about 25 to about 75 mg KOH/g.

15. The cleaning fluid of claim 13, wherein the mixture of the calcium alkyl phenol sulfide and the polyolefin phosphorosulfide further includes about 1.55% by weight and about 1.65% by weight calcium, between about 0.9% by weight and about 1.03% by weight phosphorus, and between about 2.4% by weight and about 3.2% by weight sulfur.

16. The cleaning fluid of claim 1, wherein the solvent additive includes the property of removing fouling material from a turbine component immersed in the cleaning fluid.

* * * * *